United States Patent [19]

Dilger

[11] Patent Number: 4,665,567

[45] Date of Patent: May 19, 1987

[54] PROTECTIVE MASK

[76] Inventor: Sigrid Dilger, Konrad-Kümell-Weg 31, D 7990 Friedrichshafen, Fed. Rep. of Germany

[21] Appl. No.: 823,209

[22] Filed: Jan. 28, 1986

[30] Foreign Application Priority Data

Feb. 1, 1985 [DE] Fed. Rep. of Germany ... 8502686[U]

[51] Int. Cl.[4] ..... A42B 1/18

[52] U.S. Cl. ..... 2/174

[58] Field of Search ..... 2/174

[56] References Cited

U.S. PATENT DOCUMENTS

| | | | |
|---|---|---|---|
| D. 205,829 | 9/1966 | Gettinger | 2/174 |
| 1,023,677 | 4/1912 | Pass | 2/174 |
| 1,902,441 | 3/1933 | Giuliano | 2/174 |
| 2,432,767 | 12/1947 | Klein | 2/174 |
| 2,445,487 | 7/1948 | Lester et al. | 2/174 |
| 2,507,447 | 5/1950 | Joie et al. | 2/174 |
| 2,546,117 | 3/1951 | Whelan | 2/174 |
| 3,261,027 | 7/1966 | Lambert | 2/174 |
| 4,173,042 | 11/1979 | Krzewinski-Morris | 2/174 |

*Primary Examiner*—Doris L. Troutman

*Attorney, Agent, or Firm*—McGlew and Tuttle

[57] ABSTRACT

A protective mask which is to be worn when dressing or changing clothes so as to protect a facial makeup or a hairdo, comprises a hood which is placed over the head and has a lower open end in through which the head is passed and which is made of an air permeable transparent material.

1 Claim, 3 Drawing Figures

PROTECTIVE MASK

FIELD AND BACKGROUND OF THE INVENTION

The invention relates in general to protective devices and in particular to a new and useful protective mask to be worn when changing clothes, to avoid soiling of clothes by makeup and/or to protect hairdos.

From German No. OS 25 16 892 a makeup protection in the form of an arched plate plastic is already known which is waterproof and is held before the eyes when washing one's hair. This is to prevent that the eye makup smears due to water.

SUMMARY OF THE INVENTION

The invention provides a protective mask to be worn when changing clothes which insures that when donning or doffing clothes they are not soiled by the makeup applied to the facial skin and/or that a hairdo is spoiled. The protective mask is of simple design and hence inexpensive to manufacture, and it does not hinder the wearer and is easy to handle.

According to the invention, the protective mask is designed in the form of a hood to be placed over the head and is made of an air permeable transparent material, for example a light cellulose.

The protective mask can be formed in a simple manner from a rectangular piece of material folded in the middle, whose edges are firmly joined together about each side, for example welded or sewn together. Alternatively, it may be made of a tubular piece of material whose transverse edges at one end are joined together firmly entirely or partly, for example glued, welded or sewn together.

It is further expedient to make one or both upper corner regions of the protective mask rounded to match the form of the head.

To fix the protective mask, it is expedient to provide, on its exterior lower region, one or more velcro closures, pressure-sensitive adhesive foils, snap button closures or the like; or to insert in it a preferably continuous elastic band, so that the mask can be tightened in this region and thus is held securely.

It is further advantageous to provide the protective mask with two eye slits and with air inlet openings preferably in the region correlated with the mouth or nose.

To store several protective masks a receiving box may be provided, or it is possible to join several protective masks together as a tear-off block.

The protective mask designed according to the invention is not only of simple design and hence can be manufactured economically without difficulties, but it is also easy to handle and ensures especially when changing clothes a reliable protection against soiling by makeup and also interference with a hairdo. For if the mask is made in the form of a hood comprising an air permeable transparent material, it can be placed over the head when changing clothes without restricting or hindering the wearer of the mask. The face and hairdo are reliably covered, so that the clothes will not be soiled by makeup and financial loss is avoided. In addition, the hairdo is protected. The proposed new protective mask can thus be used successively in the commercial as well as the private sector.

Accordingly, it is an object of the invention to provide a protective mask for a persons' head which is made of a lightweight transparent material and is which is adapted to fit as a hood over the person's head.

A further object of the invention is to provide a protective mask which comprises a transparent lightweight material constructed to form a head and closing hood having an open end for the entry of the head and with means at the entrance end for gathering the bag so it secures around the person's head.

A further object of the invention is to provide a protective hood for use by a person which is of transparent material and which is simple in design, rugged in construction and economical to manufacture.

The various features of novelty which characterize the invention are pointed out with particularity in the claims annexed to and forming a part of this disclousre. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
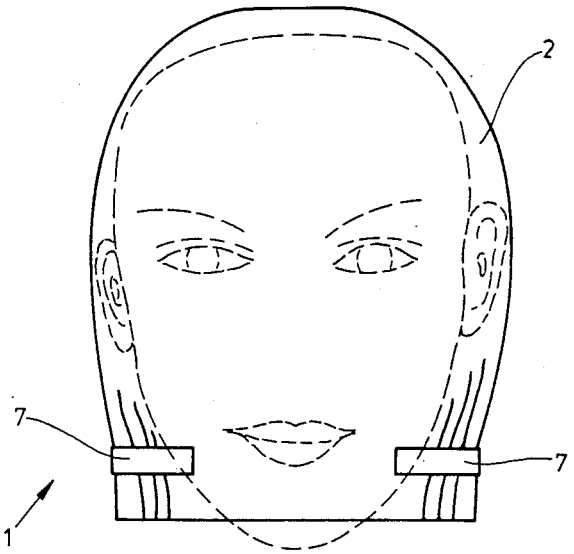
FIG. 1 is an elevational view of a protective mask placed over the head constructed in accordance with the invention.
Figure 2:
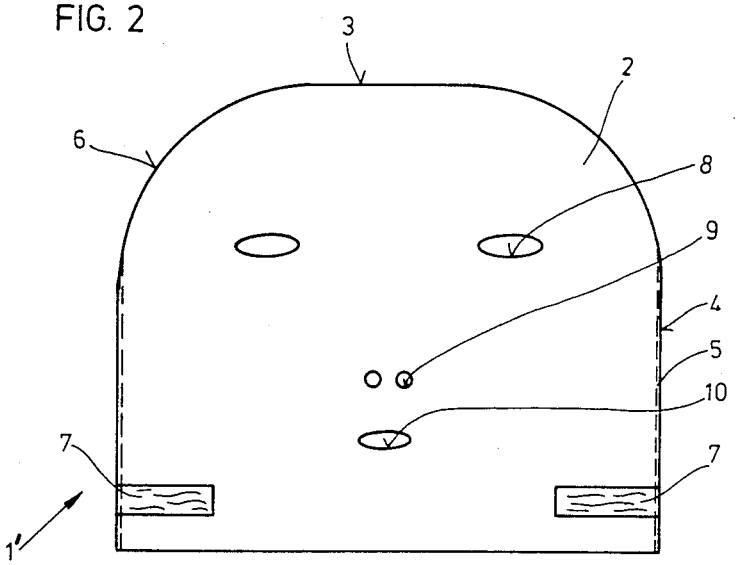
FIG. 2 is a similar view of another embodiment of the protective mask.
Figure 3:
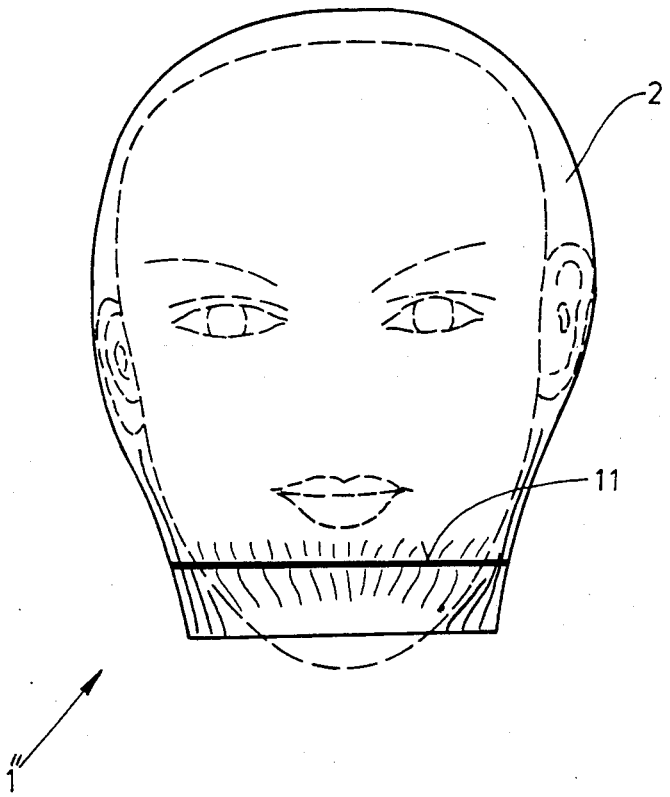
FIG. 3 is a similar view of still another form of the protective mask.

Referring to the drawings in particular the invention embodied therein comprises a protective hood generally designated 1, 1' and 1'' in FIGS. 1, 2 and 3 respectively and which is advantageously made of a lightweight material such as cellulose which is transparent and permits passage of air therethrough.

The protective mask shown in FIGS. 1 and 2 and marked 1 and 1' and 1'' has the form of a hood 2 and serves during change of clothes especially to protect the clothes against soiling by makeup applied on the facial skin. As the mask 1 is made of a transparent air permeable material, such as a non-woven material, the person wearing it is not hindered or restricted and the mask can readily be worn over a prolonged period.

As can be seen from FIG. 2, the mask 1' is made of a rectangular piece of material which is folded along a central folding edge 3 and whose sides or side edges 1 are firmly joined together or sewn together by a glue or weld material along a seam 5. In both upper corner regions a rounding 6 has been made approximately matching the form of the head. Also in this region the longitudinal edges 4 may be joined together, but it is readily possible to leave this region open.

Further, in the region of the eyes two eye slits 8 and in the region of the nose and mouth air inlet openings 9 and 10 are cut into the mask 1.

Further, in the example according to both FIGS. 1 and 1' two velcro closures marked 7 are provided on the outside of the mask 1 in its lower region. The mask having been put on, it can thus easily be gathered in this region and by overlapping mating velcro closures 7. This tightening can be fixed, so that when the garment is taken off the mask is not pulled off the wearer's head, but is securely held thereon. When changing clothes, therefore, the mask provides reliable protection of the clothing from soiling and also the wearer's hairdo is protected.

To fix the protective mask 1" there may be provided also, as can be seen from FIG. 3, an elastic band 11 which, extending all the way or only over a partial region, is inserted in the protective mask 1". Thereby it is pulled together in the lower region and hence tightened; unintended removal of the mask when changing clothes is thereby prevented.

While specific embodiments of the invention have been shown and described in detail to illustrate the application of the principles of the invention, it will be understood that the invention may be embodied otherwise without departing from such principles.

What is claimed is:

1. A protective mask to be worn when changing clothes, comprising a hood having an opening for the entrance of a person's head and adapted to be worn over the person's head and being made of an air permeable transparent light cellulose material, said hood comprising a rectangular material folded over upon itself from a central portion thereof and having side edges which are welded together, this mask being formed of a tubular piece having upward corners to match the shape of the wearer's head, and including fastening means carried by said hood adjacent to head opening including at least one of the following closures, a velcro closure, a pressure sensitive adhesive foil, and a snap button closure and including an elastic band carried at the lower portion of said hood at the opening for the head, the front of said mask being provided with two eye slits and an inlet opening adjacent the area for the mouth and nose.

* * * * *